United States Patent [19]

Eller

[11] 4,350,476

[45] Sep. 21, 1982

[54] HYDRAULIC MOTOR SYSTEM FOR DRIVING A SUBMERSIBLE IMPELLER PUMP IN WHICH HYDRAULIC SURGE AT START-UP AND SHUT-DOWN IS CUSHIONED

[76] Inventor: J. David Eller, 33 NW. 2 St., Deerfield Beach, Fla. 33441

[21] Appl. No.: 172,201

[22] Filed: Jul. 25, 1980

[51] Int. Cl.[3] ..... F04B 49/02; F04B 9/10

[52] U.S. Cl. ..... 417/304; 417/308; 417/390

[58] Field of Search ..... 417/390, 304, 308; 60/414

[56] References Cited

U.S. PATENT DOCUMENTS 3,297,236 1/1967 Eckerle et al. ..... 417/304 X 4,138,202 2/1979 Eller ..... 417/390 X

*Primary Examiner*—Leonard E. Smith

*Attorney, Agent, or Firm*—Oltman and Flynn

[57] ABSTRACT

The present hydraulic system for driving a submersible pumping unit has an above-ground pump for pumping oil through a hydraulic motor in the submersible pumping unit which has a gate valve to prevent the reverse flow of water after the submersible pumping unit is turned off. A pressure regulating valve limits the oil pressure to the hydraulic motor. The inlet flow to the above-ground pump is filtered. In the present improvement, the hydraulic surge at start-up and shut-down is cushioned by bypassing hydraulic fluid through an accumulator which causes pressure at the motor in the submersible pumping unit to build-up relatively gradually at start-up and decrease relatively gradually at shut-down.

3 Claims, 2 Drawing Figures

HYDRAULIC MOTOR SYSTEM FOR DRIVING A SUBMERSIBLE IMPELLER PUMP IN WHICH HYDRAULIC SURGE AT START-UP AND SHUT-DOWN IS CUSHIONED

BACKGROUND OF THE INVENTION

Submersible pumping units in use heretofore have included a hydraulic motor driving an axial flow pump and both mounted in a casing that is lowered into water. The hydraulic motor is connected through hoses or pipes to an above-ground pump, which pumps oil through the hydraulic motor to drive it, with the return flow of oil going back to an above-ground tank which supplies the oil to the above-ground pump as in U.S. Pat. No. 4,138,202.

The hydraulic motor and the pump in the submersible pumping unit are stopped by turning off the above-ground pump. When this happens, the water in the submersible pump unit tends to flow back down by gravity and rotate the impeller of the submerged pump in reverse. This pump, in turn, tends to drive the hydraulic motor in reverse, causing the latter to pump oil in reverse through the above-ground pump. A gate valve on the pumping unit prevents reverse flow of water through the pump. However, the gate valve may bang shut at shut-down damaging the submersible unit.

An aspect of this invention is concerned with relieving hydraulic surge at start-up and shut-down, and with preventing abrupt closing of the gate valve of the pumping unit at shut-down.

SUMMARY OF THE INVENTION

In this presently-preferred embodiment a pressure regulating valve is connected in a bypass line with a sight glass extending between the outlet side of the above-ground pump and the low pressure return to the oil tank. This pressure regulating valve relieves any excess pressure and normally maintains a constant oil pressure for operating the hydraulic motor in the submersible pumping unit.

In the present improvement, a bypass line from the pressure regulating line leads to an accumulator which causes pressure at the hydraulic motor to build-up gradually at start-up and decrease gradually at shut-down, thus cushioning hydraulic surge.

The objects and advantages of the present invention will be apparent from the following detailed description of the presently-preferred embodiment thereof, which is shown schematically in the the accompanying drawings.

Figures 1, 2:
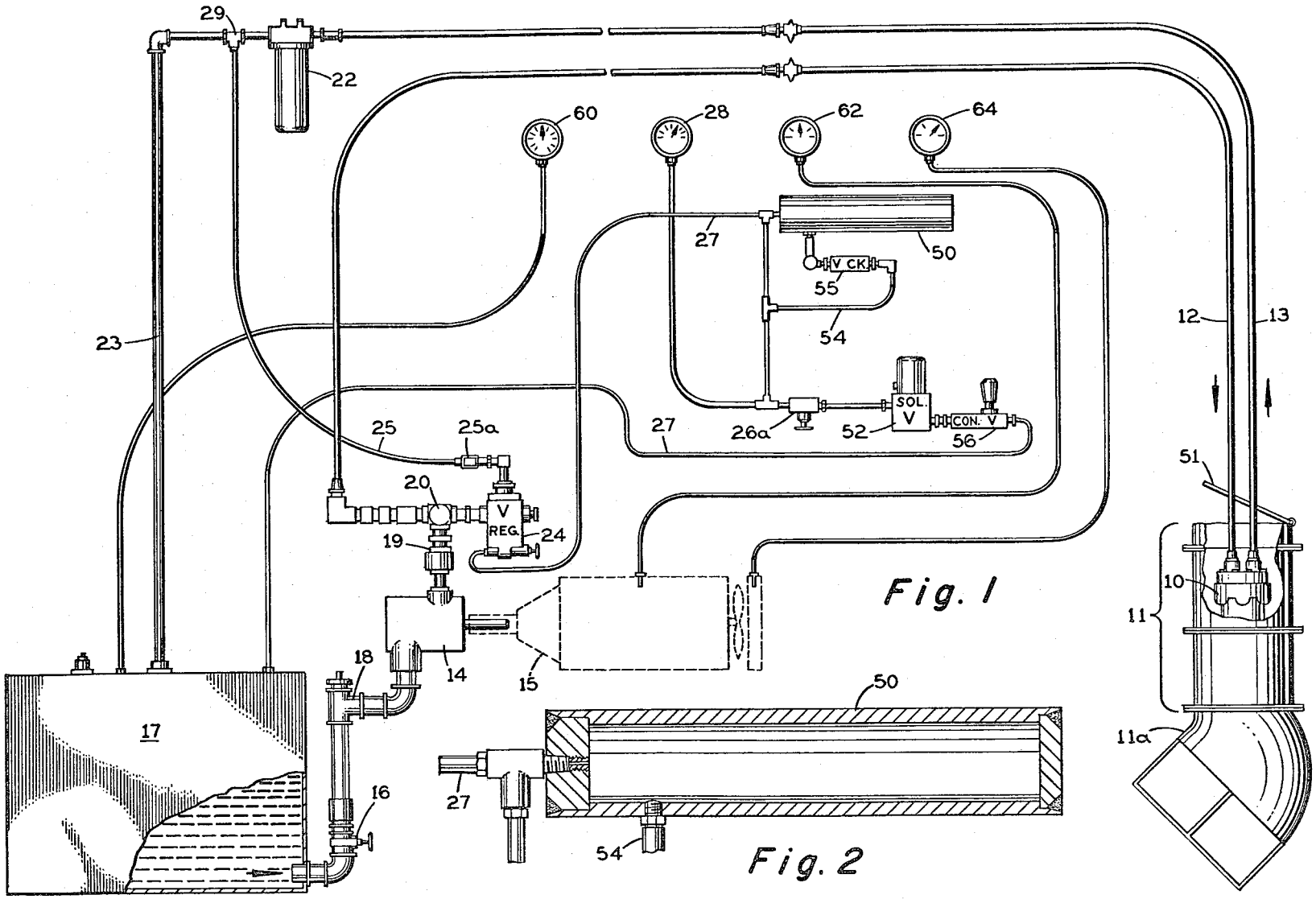
FIG. 1 is a schematic drawing of the system of the invention.
FIG. 2 shows a hydraulic accumulator included in the system of FIG. 1.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

The hydraulic system of the present invention is shown connected to a submersible pumping unit which includes a hydraulic motor 10 of known design mounted inside a casing 11 which, as shown, has an inclined intake scoop 11*a* at its lower end. The hydraulic motor 10 has a rotary output shaft coupled to the impeller of an axial flow pump of known design, which is located inside the casing 11 just above the latter's intake scoop 11*a*. The pumping unit has a head of water above the gate valve, and the pumping unit is normally horizontal.

The hydraulic motor 10 is driven in one rotational direction so that it will rotate the pump impeller in a direction for pumping the water longitudinally through the casing 11 past the hydraulic motor. For this purpose the hydraulic motor 10 is provided with an inlet hose 12 and a return hose 13, both of which extend down to the hydraulic motor 10 from the aforementioned ground-level mobile unit.

The upper end of the hydraulic motor inlet hose 12 is operatively connected to the outlet side of a constant volume vane pump 14 or other type hydraulic pump driven by a prime mover 15, which may be an electric motor or a diesel engine. The inlet side of the pump 14 is operatively connected through a normally open, manually operated gate value 16 to the lower end of an oil tank 17. All of these components are in the above-ground mobile unit.

A screen type strainer/filter 18 is located between the outlet side of the gate valve 16 and the inlet side of the above-ground pump 14 to protect the latter against metal particles which sometimes are left inside the oil tank 17 when its side and bottom walls are welded to one another.

The outlet side of the above-ground pump 14 is connected through two successive T-fittings 19 and 20 to the inlet hose 12 for the hydraulic motor 10. The return hose 13 from the hydraulic motor 10 is operatively connected through an oil filter 22 of known design to the low pressure return line 23 for the oil tank 17.

A bypass circuit is connected between the outlet side of the above-ground pump 14 and the return line 23 for the oil tank. This bypass circuit includes a fitting 24 containing a pressure regulating valve of known design which has its inlet connected to the second T-fitting 20 at the outlet side of the pump. This pressure regulating valve has a bypass outlet connected through a line 25 to a return line 23 at fitting 29. Whenever the pump pressure exceeds 2,000 psi, for example, the pressure regulating valve in fitting 24 bypasses the excess pump pressure to the return line 23. The valve 26*a* is opened to relieve pressure on the system for engine starting.

The valve 26*a* may optionally be closed for system operation after complete start-up but is opened for shut-down. The manual valve may be left open after start-up. The gate valve 51 is open during system operation.

A hydraulic accumulator 50 is connected in the bypass line 27 for causing hydraulic pressure at the pressure regulator valve 24 to build up gradually at start-up and decrease gradually at shut-down. A normally open automatic solenoid valve 52 in the bypass line 27 closes at start-up to cause pressure at the pressure regulator valve to build-up gradually until the pilot system in the pressure regulating valve diverts fluid to the motor 10 to build the pressure there up to operating pressure. One the system has reached operating pressure, the manual valve 26*a* may optionally be closed and re-opened only when shut-down is desired. Alternatively, valve 26*a* may be left open. This manual valve 26*a* acts as a standby control for pressure relief in case the solenoid valve 52 should malfunction.

The accumulator 50 has a drain line 54 in which a check valve 55 is connected. At shut-down, the solenoid valve 52 opens to drain the accumulator through the drain line 54 to cause pressure to drop suddenly at the motor 10 until the gate valve 51 partially closes. A flow control valve 56 in bypass line 27 limits the presure drop to a selected value, say 500 psi, which allows the motor to keep the submersible pumping unit operating at low speed for a short time. Then, the solenoid valve 52 reopens to permit pressure to drop to 0 for total shut-down, and the gate valve 51 closes.

Thus, hydraulic surge at start-up and shut-down is cushioned. The gate valve 51 does not bang shut at shut-down in such a way as to cause damage to the submersible pumping unit.

Gauge 28 displays system pressure. Gauge 60 displays filter vacuum. Gauge 62 displays engine oil pressure in the above-ground unit, and gauge 64 displays engine water temperature there.

A fitting 25*a* having a viewing window is connected between the bypass outlet of the pressure regulating valve in the fitting 24 and the bypass line 25. The user of the present apparatus can observe the existence of a bypass flow into conduit 25 through fitting 25*a* and thereby be informed of any abnormality in the system's operation which might require a shut-down or adjustment to correct the problem.

The pressure gauge 28 is connected in line 27, which is connected arought regulating valve 24, and to the fitting 24 to provide a visual reading of the pump output pressure.

I claim:

1. In combination with a submersible pumping unit with a gate valve and having a rotary pump including an impeller for pumping water, a hydraulic motor in driving relationship with said pump for rotating said pump in one direction to pump the water, and hydraulic lines connected to opposite sides of said motor;

and an above-ground hydraulic system for operating said hydraulic motor in the submersible pumping unit, said hydraulic system including an oil tank, an above-ground pump operatively connected to pump oil from said tank to one of said hydraulic lines of the submersible pumping unit to drive the hydraulic motor for rotating said first-mentioned pump in said one direction, and return conduit means connected between the other of said hydraulic lines for the hydraulic motor in the submersible pumping unit and said oil tank to return the oil from said hydraulic motor to said tank;

the improvement which comprises:

a bypass pressure regulating valve connected in series with means including oil viewing means between the outlet side of said above-ground pump and said return conduit means for said oil tank to limit the pressure of the oil which operates said hydraulic motor in the submersible pumping unit by bypass oil flow, said oil viewing means enabling viewing of bypass oil flow through said regulating valve for adjustment purposes;

a bypass line connected in parallel around said pressure regulating valve;

a hydraulic accumulator in said bypass line for causing hydraulic pressure at the pressure regulating valve to build up gradually at start-up and decrease gradually at shut-down;

a normally open automatic valve in said bypass line which closes at start-up to cause pressure at said pressure regulating valve to build up gradually until said pressure regulating valve diverts fluid to said motor to build up to operating pressure there;

said automatic valve opening at shut-down to drain said accumulator and cause pressure at the motor to decrease;

a flow control valve in said bypass line for limiting the decrease in pressure at shut-down to a selected level at which said motor operates at low speed to stop the closing of said gate valve;

and said automatic valve re-opening after a selected time to permit total shut-down and closing of said gate valve.

2. Apparatus according to claim 1 further including:

a manual valve in said bypass line that is opened upon starting and which may optionally be closed for system operation.

3. Apparatus according to claim 2 further including;

a check valve for draining said accumulator.

* * * * *